US005610360A

United States Patent [19]

Kazyaka et al.

[11] Patent Number: 5,610,360

[45] **Date of Patent: *Mar. 11, 1997**

[54] LARGE CALIBER GUN MUFFLER

[75] Inventors: Raymond P. Kazyaka; Raymond J. Kazyaka, both of Scotia, N.Y.

[73] Assignee: Wright Malta Corporation, Ballston Spa, N.Y.

[ * ] Notice: The term of this patent shall not extend beyond the expiration date of Pat. No. 5,398,589.

[21] Appl. No.: 419,381

[22] Filed: Mar. 14, 1995

Related U.S. Application Data

[63] Continuation-in-part of Ser. No. 181,398, Jan. 12, 1994, Pat. No. 5,398,589.

[51] Int. Cl.[6] ..... F41A 21/30

[52] U.S. Cl. ..... 89/14.4; 181/223; 181/225

[58] Field of Search ..... 89/14.3, 14.4; 181/223, 225

[56] References Cited

U.S. PATENT DOCUMENTS

| | | | |
|---|---|---|---|
| 1,017,003 | 2/1912 | Kenney | 89/14.4 |
| 1,207,264 | 12/1916 | Bailey | 89/14.4 |
| 1,462,158 | 7/1923 | Wildner | 89/14.4 |
| 2,208,093 | 7/1940 | Brown | 89/14.4 |
| 2,798,743 | 7/1957 | Olsten | 285/47 |
| 3,120,877 | 2/1964 | Morris et al. . | |
| 3,693,432 | 9/1972 | Stewart et al. | 73/161 |
| 3,710,679 | 1/1973 | Werbell, III . | |
| 4,733,751 | 3/1988 | Piesik | 181/217 |
| 4,907,488 | 3/1990 | Seberger | 89/14.4 |
| 5,136,924 | 8/1992 | Forster et al. | 89/14.4 |

FOREIGN PATENT DOCUMENTS

| | | | |
|---|---|---|---|
| 63622 | 2/1914 | Austria | 89/14.4 |
| 351625 | 4/1922 | Germany | 89/14.4 |
| 8153 | of 1884 | United Kingdom | 89/14.4 |
| 498775 | 1/1939 | United Kingdom | 89/14.4 |
| 1016570 | 1/1966 | United Kingdom | 89/14.3 |

OTHER PUBLICATIONS

Schwager, The Muzzle Brake, The Coast Artillery Journal, pp. 32–36, May/Jun. 1945.

Fansler et al., Attenuation of Muzzle Blast, FIGS. 1–16 and 6 pages of text, Oct. 1987.

The Washington Post and Times Herald, "Navy Can Silence A Howitzer", Oct. 19, 1957, p. A3.

*Primary Examiner*—Stephen M. Johnson

*Attorney, Agent, or Firm*—Ratner & Prestia

[57] ABSTRACT

A muffler for a large caliber gun having a gun tube includes a transition section fitted around the gun tube and engaging the gun tube for preventing the escape of residual combustion gases caused by the firing of a projectile by the gun. Attached to the transition section is at least one pressure vessel which defines a pressure chamber for containing residual combustion gases and attenuating pressure waves. A vent stack is coupled to the pressure vessel at a port of the pressure chamber, and an exhaust blower is disposed in the vent stack for removing residual combustion gases from the pressure chamber between firings. A valve, disposed in the vent stack between the pressure chamber and the exhaust blower, closes during firings of the gun and opens between firings for permitting the exhaust blower to remove residual combustion gases from the pressure chamber. At least one orifice plate, which is disposed in the pressure chamber and is adjustable relative to the pressure vessel, serves to attenuate pressure waves. Preferably, there are two pressure vessels, including a main pressure vessel and an extension pressure vessel, disposed in series with one another.

9 Claims, 10 Drawing Sheets

LARGE CALIBER GUN MUFFLER

This patent application is a continuation-in-part of application Ser. No. 08/181,398, filed Jan. 12, 1994 now U.S. Pat. No. 5,398,589.

FIELD OF THE INVENTION

The present invention relates to a muffler for minimizing the noise generated by the firing of a large caliber gun.

BACKGROUND OF THE INVENTION

Due to the increased population in the world, the noise generated by the testing of large caliber weapon systems in communities located near testing facilities of such weapon systems is becoming an increasing problem. As a result of this concern in noise, there has been a need for a gun muffler to attenuate the generated noise level. Preferably, such a gun muffler should be able to rapidly and safely attenuate the noise generated by the firing of a projectile by a large caliber gun.

SUMMARY OF THE INVENTION

The present invention is directed to a muffler for a large caliber gun having a gun tube. The muffler includes a transition section fitted around the gun tube and engaging the gun tube for preventing the escape of residual combustion gases caused by the firing of a projectile by the gun. At least one pressure vessel is attached to the transition section and defines a pressure chamber for containing residual combustion gases and attenuating pressure waves caused by the firing of the gun. A vent stack is coupled to the pressure vessel at a port of the pressure chamber. Disposed in the vent stack is an exhaust blower, which serves to remove residual combustion gases from the pressure chamber between firings. In the vent stack between the pressure chamber and the exhaust blower is a valve. The valve closes during firings of the gun to prevent pressure waves caused by the firing from escaping directly to the atmosphere during firing. The valve is opened between firings for permitting the exhaust blower to remove residual combustion gases from the pressure chamber. Finally, at least one orifice plate, which is disposed in the pressure chamber and is adjustable relative to the pressure vessel, serves to attenuate pressure waves.

The invention also includes a gun muffler including a transition section, at least one pressure vessel, and at least one orifice plate, which is disposed in the pressure chamber and is adjustable relative to the pressure vessel, as discussed above.

According to a preferred embodiment of the present invention, two pressure vessels, including a main pressure vessel and an extension pressure vessel, are disposed in series with and connected to the transition section. The main pressure vessel defines a main pressure chamber, and the extension pressure vessel defines an extension pressure chamber. The two pressure vessels may be generally cylindrical. In accordance with one embodiment of the invention, the main pressure chamber has a volume of about 4,000 cubic feet, and the extension pressure chamber has a volume of about 1,000 cubic feet.

According to a preferred embodiment of the invention, the muffler includes a first, second, and third orifice plate, each having an orifice, through which the projectile passes and which is adjustable relative to the longitudinal axis of the pressure vessel. More preferably, the first and second orifice plates are disposed in series with one another in the extension pressure vessel, and the third orifice plate is disposed in the extension pressure chamber near the connection of the main pressure vessel to the extension pressure vessel. The third orifice plate serves to control static pressure in the main pressure chamber. The first, second, and third orifices may be circular and disposed off-centered relative to the first, second, and third orifice plates, respectively. Alternatively, the first, second, and third orifices may be elliptical.

According to another embodiment of the present invention, the main pressure vessel may include a second port, at which an access cover is mounted. Additionally, a plurality of side ports may be disposed along the extension pressure vessel and the main pressure vessel for access, photography, radar, and viewing. In addition, a sabot catcher may be disposed within either pressure vessel for entrapping particulates.

According to another embodiment of the present invention, a supplemental tube is placed in abutment against the gun tube during firing of the gun and extends longitudinally along the center axis of the pressure vessel. A supplemental tube transporter assembly transports the supplemental tube longitudinally along the pressure vessel. The assembly includes a first and a second pair of wheels which respectively engage and move along a first and a second track. The tracks extend parallel to one another and longitudinally along the inner surface of the pressure vessel. A first and second extendable arm, which are respectively coupled to the first and second pair of wheels, are selectively attached to the supplemental tube.

BRIEF DESCRIPTION OF THE DRAWINGS

The invention is best understood from the following detailed description when read in connection with the accompanying drawings, in which.

DETAILED DESCRIPTION OF THE INVENTION

The present invention is directed to a muffler for a large caliber gun having a gun tube. As used herein, a "large caliber gun" refers to a gun having the size of at least 155 mm. Although a muffler in accordance with the present invention could be made for smaller guns, for example, as low as 30 mm, it is normally not needed to muffle the noise generated from such smaller guns. With a gun muffler of the present invention, the noise level is attenuated by 30% at 100 yards from the firing of the gun and by 95% at 300 yards from firing of the gun.

Figure 1:
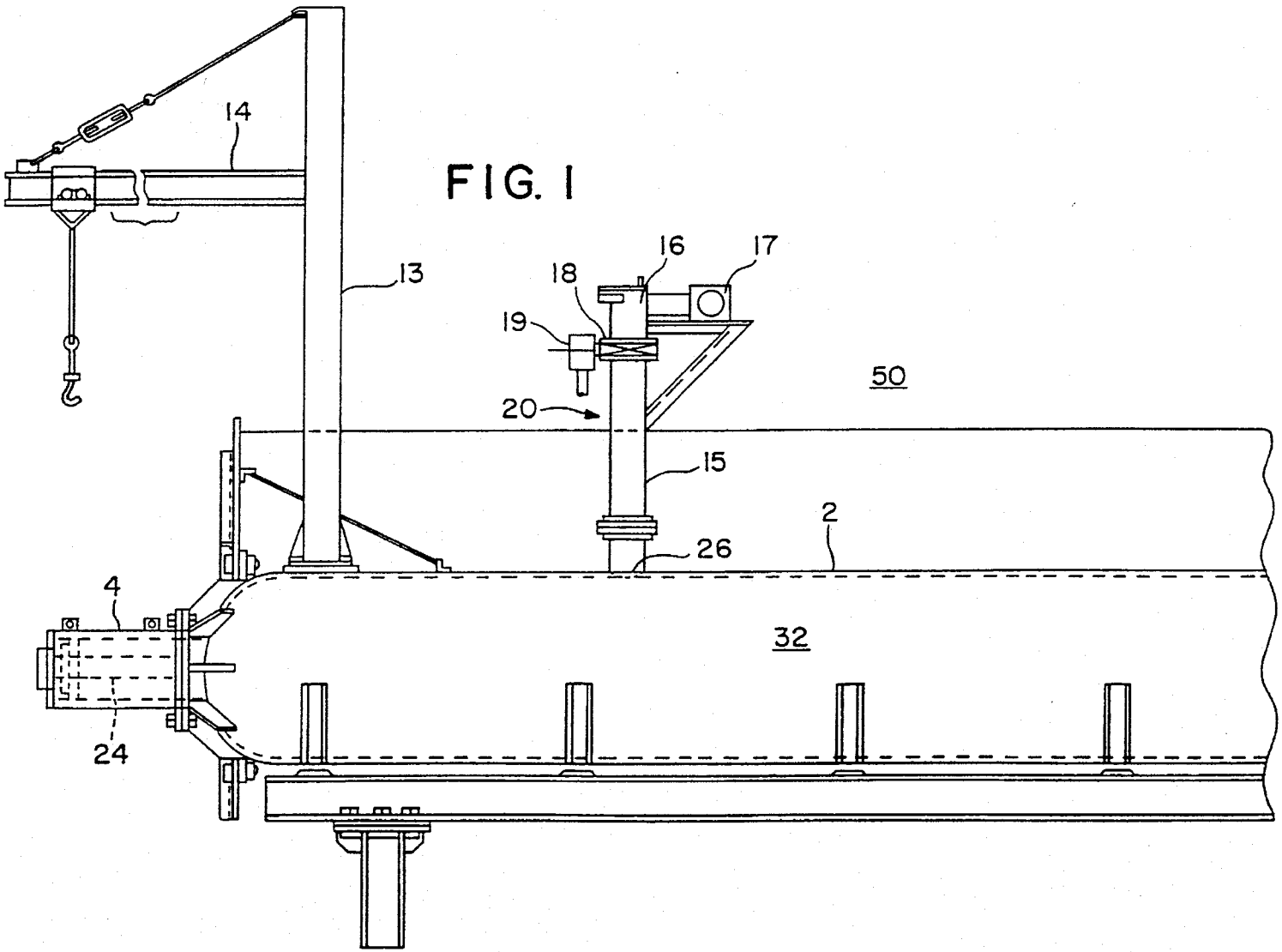
FIG. 1 is a fragmentary longitudinal side elevational view of the left portion of a first embodiment of a gun muffler of the present invention.
Figure 1A:
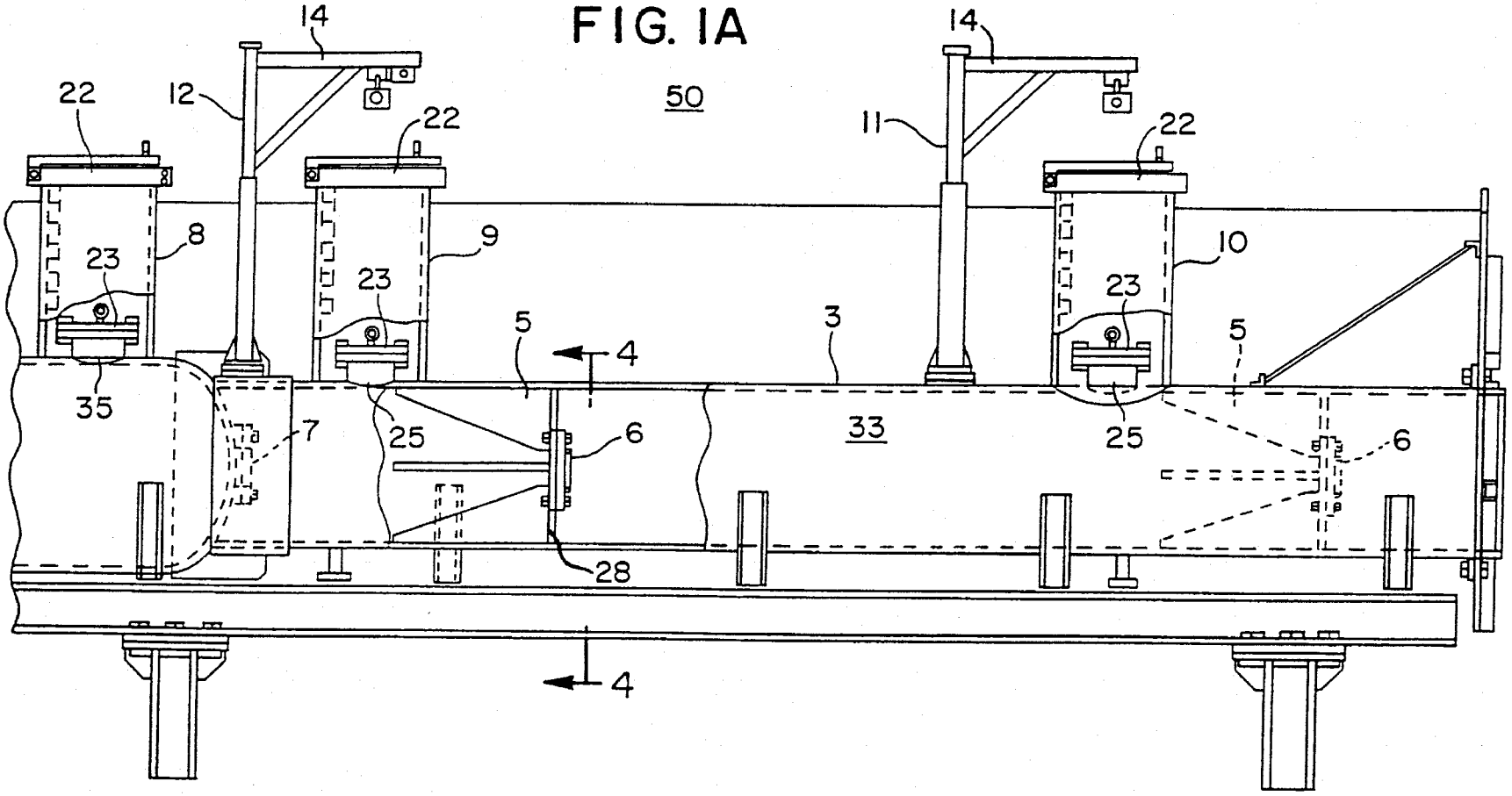
FIG. 1A is a fragmentary longitudinal side elevational view of the right portion of the gun muffler shown in FIG. 1.

Referring to FIGS. 1 and 1A, a gun muffler 50 in accordance with a first embodiment of the present invention is shown. The gun muffler includes a transition section 4 which fits around the gun tube 24 and engages the gun tube for preventing the escape of residual combustion gases caused by a firing of the gun. At least one pressure vessel is attached to transition section 4. As shown in FIGS. 1 and 1A, the pressure vessels include a main pressure vessel 2 defining a main pressure chamber 32 and an extension pressure vessel 3 defining an extension pressure chamber 33. Extension pressure vessel 3 is disposed in series with and connected to main pressure vessel 2. The two pressure vessels may be bolted together.

As shown, main pressure vessel 2 and extension pressure vessel 3 are generally cylindrical. In one embodiment, the main pressure vessel is about 4,000 cubic feet (9 feet in diameter and 64 feet long) and the extension pressure chamber is approximately 1,000 cubic feet.

Main pressure vessel 2 includes a port 26. A vent stack 20 is coupled to main pressure vessel 2 at port 26 and includes a lower vent stack 15 and an upper vent stack 16. Lower vent stack 15 is in permanent fluid communication with main pressure chamber 32 by way of port 26. Disposed in upper vent stack 16 is an exhaust blower 17. Exhaust blower 17 should be capable of rapidly creating a vacuum in main pressure chamber 32 and extension pressure chamber 33 for venting residual combustion gases from these chambers to the atmosphere by way of port 26. Blower 17 may be a squirrel-cage blower having drum type blowers or vanes.

Disposed in vent stack 20 is a valve 18, which separates upper vent stack 16 from lower vent stack 15. Accordingly, valve 18 is disposed between main pressure chamber 32 and exhaust blower 17. Valve 18 is actuated by actuator 19, which is air-operated. Valve 18 should be capable of withstanding high pressure, for example, pressure above 600 psi.

According to an embodiment of the invention, valve 18 is a commercially available butterfly valve having a twenty-four inch diameter through port and is capable of operating at 1,000 psig. Also, actuator 19 can be a pneumatic actuator which operates at 100 psig and is controlled by an electrically operated solenoid valve. Valve 18 is operated to be closed during firings of the gun and opened between firings of the gun.

At the end of main pressure vessel 2 which is coupled to extension pressure vessel 3 is an orifice plate 7. Orifice plate 7 is an annular disk defining a central circular hole through which the projectile passes. The size of the hole is dictated by the size of the projectile. Also, if the hole is too small, it is difficult to rapidly vent extension pressure chamber 33 through the hole and out through port 26 by way of exhaust blower 17. On the other hand, if the hole of orifice plate 7 is too large, the muffling of sound is not sufficient. It has been found that for a projectile of 155 mm, the orifice plate 7 should have a hole of about ten inches in diameter.

Figure 4:
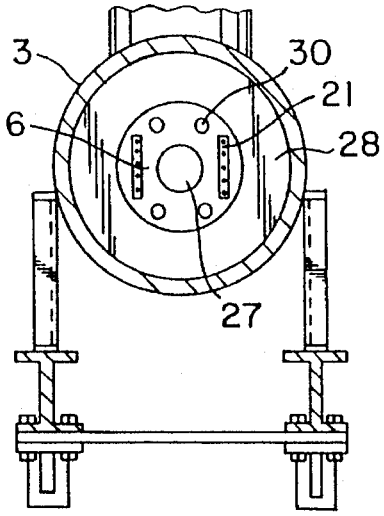
FIG. 4 is a fragmentary transverse vertical sectional view, showing the orifice plate, taken along the line 4—4 of FIG. 1A.

As shown in FIG. 1A, two baffle and orifice assemblies are disposed in series in extension pressure chamber 33. These energy-absorbing baffle and orifice assemblies each comprise a baffle 5 and an orifice plate 6. Baffles 5 are generally conical in shape, having a diameter which linearly decreases from the entry end of extension pressure chamber 3 to the exit end of extension pressure chamber 3. Baffle 5 abuts against orifice plate 6, which is also shown in FIG. 4. A retaining wall 28 is coupled to extension pressure chamber 3, and orifice plate 6 is mounted to retaining wall 28 by way of straps 21 and nuts and bolts 30. Similar to orifice plate 7, orifice plate 6 defines a central hole 27 through which a projectile passes. The diameter of hole 27 is defined by similar functional requirements as the diameter of the hole of orifice plate 7.

Also shown in FIG. 1A are vent/access stacks 8, 9, 10. Vent/access stacks 8, 9, 10 include stack covers 22, which could be mounted by way of a hinge to the vent/access stacks. Each vent/access stack covers an access cover 23 which is mounted over an access port 25, 35. Access ports 25 are in communication with extension pressure chamber 33, and access port 35 is in communication with main pressure chamber 32. The purpose of these access stack assemblies is to permit personnel to enter into main pressure chamber 32 or extension pressure chamber 33 for maintenance or repair.

Because of the size and weight of the parts of vent/access stacks 8, 9, 10 cranes 11, 12, each having crane arms 14, are used to remove and replace stack covers 22 and access covers 23. Furthermore, crane 13, having crane arm 14, is used to remove and mount transition section 4.

Figure 2:
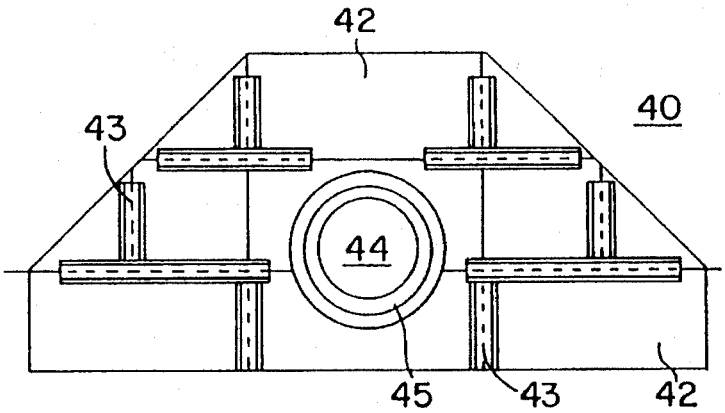
FIG. 2 is an elevational view of the reinforced left-end plate of the gun muffler.
Figure 3:
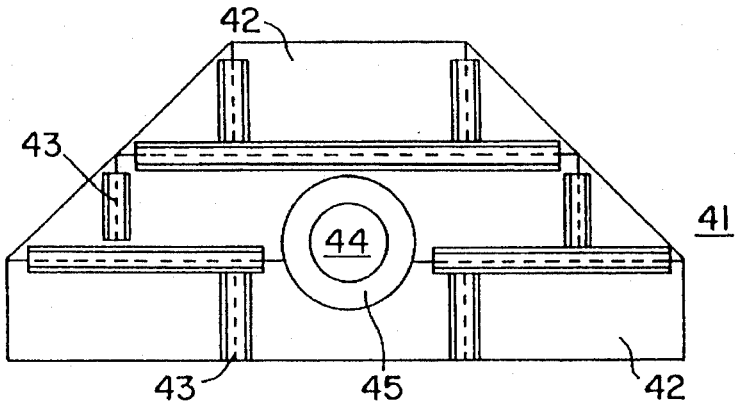
FIG. 3 is an elevational view of the reinforced right-end plate of the gun muffler.

FIGS. 2 and 3 show respectively the left-end plate 40 and right-end plate 41 of the present invention. Each end plate includes individual plates 42 which are connected to one another by connector beams 43. Each end plate defines a central hole 44. Preferably, each end plate includes removable annular disks 45 so that the diameter of central hole 44 can be changed to accommodate various sizes of guns.

Left-end plate 40 is placed vertically at the entry end of transition section 4. A gun tube is pushed through central hole 44 and into transition section 4. Preferably, the innermost removable annular disk 45 sealingly engages the gun tube.

Right-end plate 41 is placed on the exit end of extension pressure chamber 3. A supplemental tube is placed through central hole 44. Preferably, the innermost annular disk 45 sealingly engages the supplemental tube.

The purpose of left-end plate 40 and right-end plate 41 is to retain sand so that the main pressure vessel 2 and extension pressure vessel 3 can be entirely covered in sand during operation. By covering the muffler 50 in sand, the muffling effect is increased, although the muffler need not be covered in sand.

Figure 5:
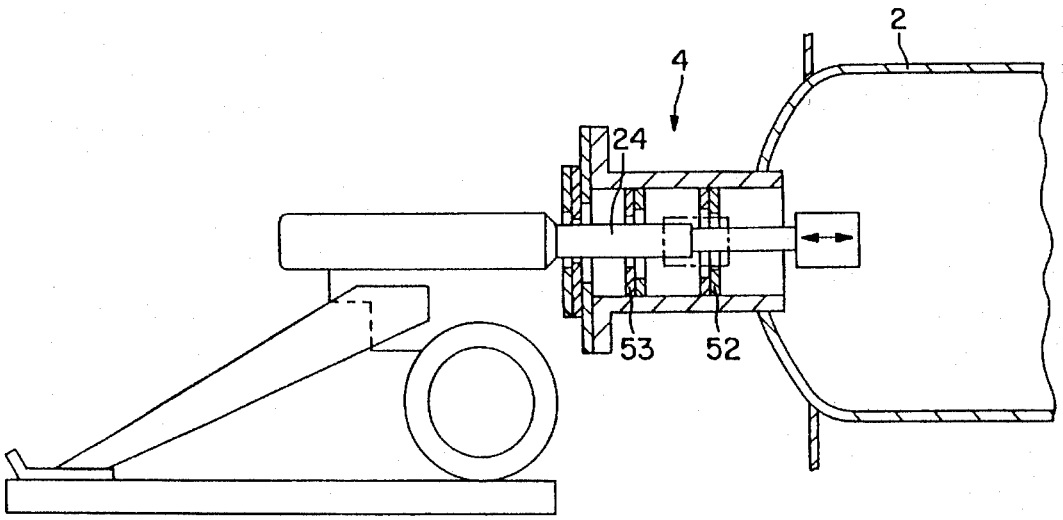
FIG. 5 is a fragmentary side elevational view of a gun and gun muffler, partly in section.
Figure 6:
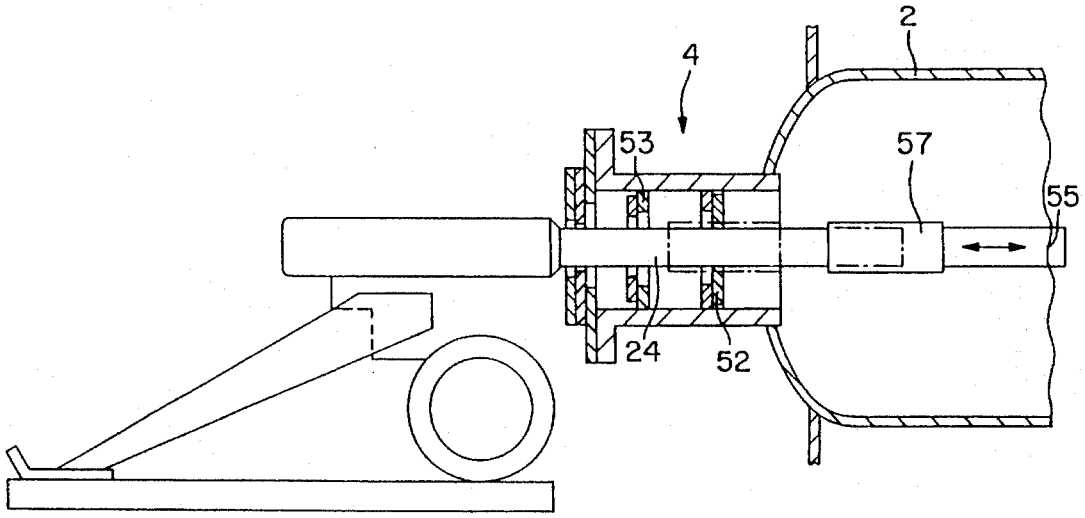
FIG. 6 is a fragmentary side elevational view of a gun, having a longer tube than the gun shown in FIG. 5 and the gun muffler, partly in section.

FIGS. 5 and 6 show transition section 4 in detailed cross section. FIG. 5 shows a gun having a shorter gun tube than the gun tube of FIG. 6. In either case, transition section 4 includes radially inward protruding flanges 52, 53 which serve as seals for engaging gun tube 24 for preventing residual combustion gases caused by the firing of the gun from escaping back through transition section 4. FIG. 6 also shows a supplemental tube 55 having an enlarged portion 57 which fits over gun tube 24. The projectile passes through gun tube 24 and through supplemental tube 55 through the entire muffler 50.

Figure 7:
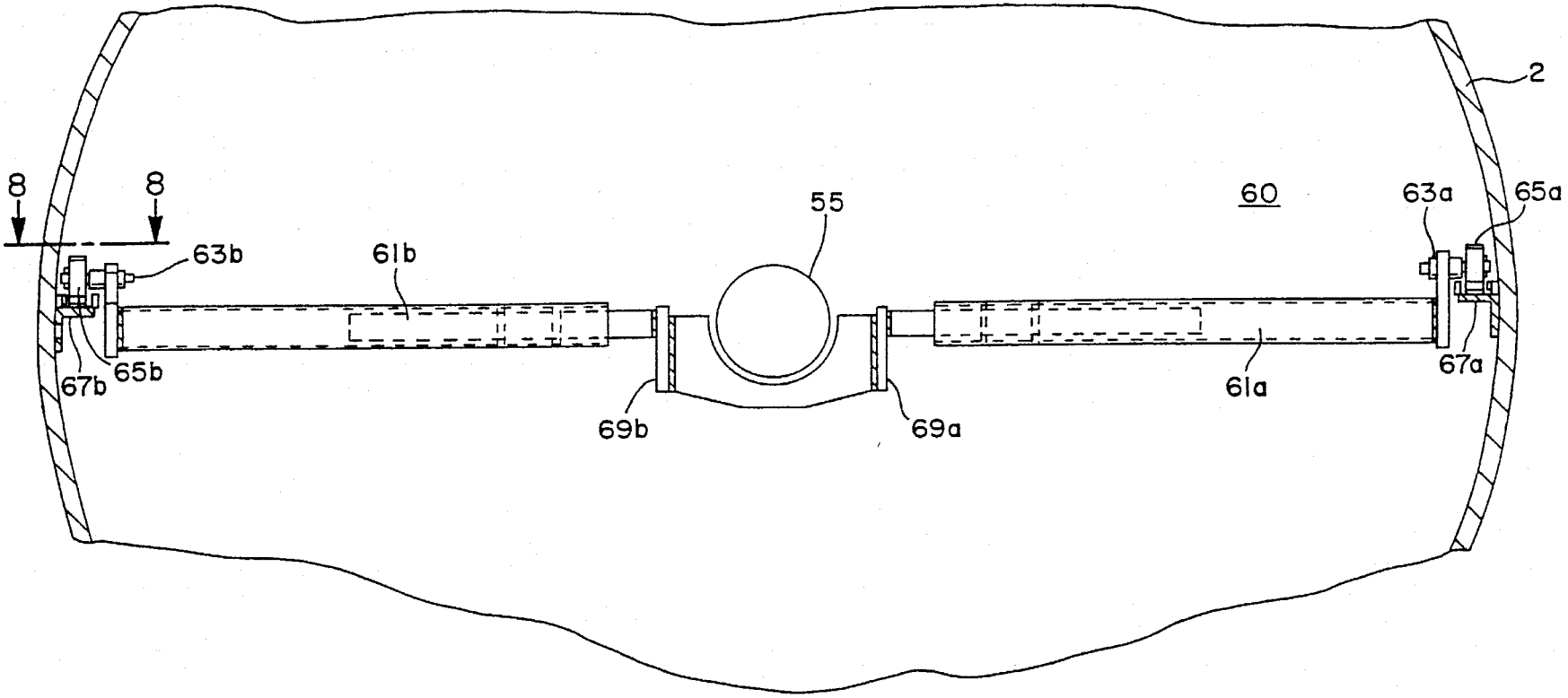
FIG. 7 is an enlarged fragmentary transverse sectional view, showing a tube transporter in accordance with the present invention.
Figure 8:
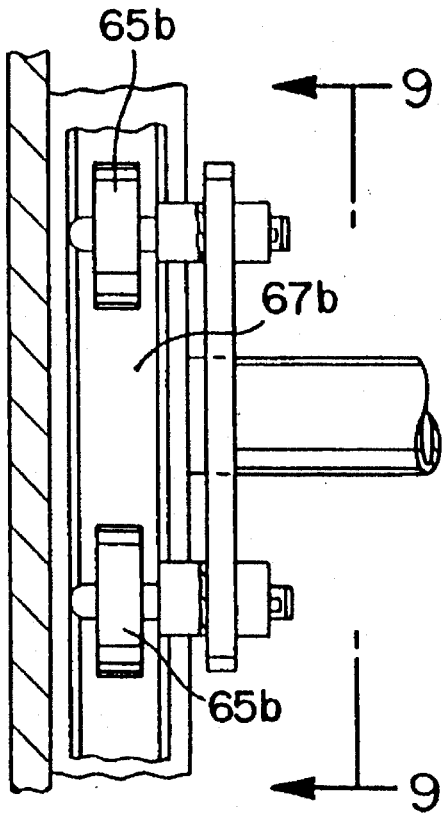
FIG. 8 is an enlarged fragmentary horizontal sectional view of a portion of the tube transporter of FIG. 7, taken along the line 8—8 of FIG. 7.

FIG. 7 shows a cross section of main pressure vessel 2 at a point through which supplemental tube 55 extends. A supplemental tube transporter assembly 60 is shown. Supplemental tube transporter assembly 60 includes a first extendable arm 61*a* and a second extendable arm 61*b*. At one end of each extendable arm is a coupling 63*a,b* respectively, for coupling each extendable arm to a respective pair of wheels 65*a,b*. As shown in FIG. 8, wheels 65*a,b* engage and move along respective tracks 67*a,b*, which extend parallel to one another and longitudinally along the inner surface of main pressure vessel 2. Such a transporter tube assembly 60 could also be disposed in extension pressure chamber 33. The supplemental tube transporter assembly 60 also includes flanges 69*a,b* respectively coupled to the ends of extendable arms 61*a,b* opposite the ends attached to the wheels. Flanges 69*a,b* are selectively attached to supplemental tube 55.

In operation, transporter tube assembly 60 is used to transport supplemental tube 55 from the exit end of extension pressure chamber 3 to a point so that it engages with a gun tube 24. This is done by first rolling wheels 65*a,b* along tracks 67*a,b* towards the exit end of the pressure vessel. Then, supplemental tube 55 is pushed through the exit hole of the extension pressure vessel 3 and into extension pressure chamber 33. Extendable arms 61*a,b* are extended so that flanges 69A,B are in engagement with supplemental tube 55. Then, the entire assembly 60 is moved towards the entry end of the pressure vessel.

After placing the supplemental tube in engagement with the gun tube and securing the transition section over the top of the gun tube, the gun is ready for firing. Initially, valve 18 is closed when the gun is fired. As a consequence of firing, combustion gases fill main pressure chamber 32 and extension pressure chamber 33. The pressure waves caused by the firing of the gun are attenuated by orifice plate 7 and the baffle and orifice plate assemblies disposed in series in extension pressure chamber 33. Thus, both pressure vessels serve to contain residual combustion gases and attenuate the pressure waves.

Immediately after firing and attenuation of the pressure waves, valve 18 is opened thereby permitting exhaust blower 17 to remove the residual combustion gases from the main pressure chamber. This process is repeated rapidly. As mentioned above, main pressure vessel 2 and extension pressure vessel 3 are preferably covered with sand, which is contained by left-end plate 40 and right-end plate 41.

Figure 10:
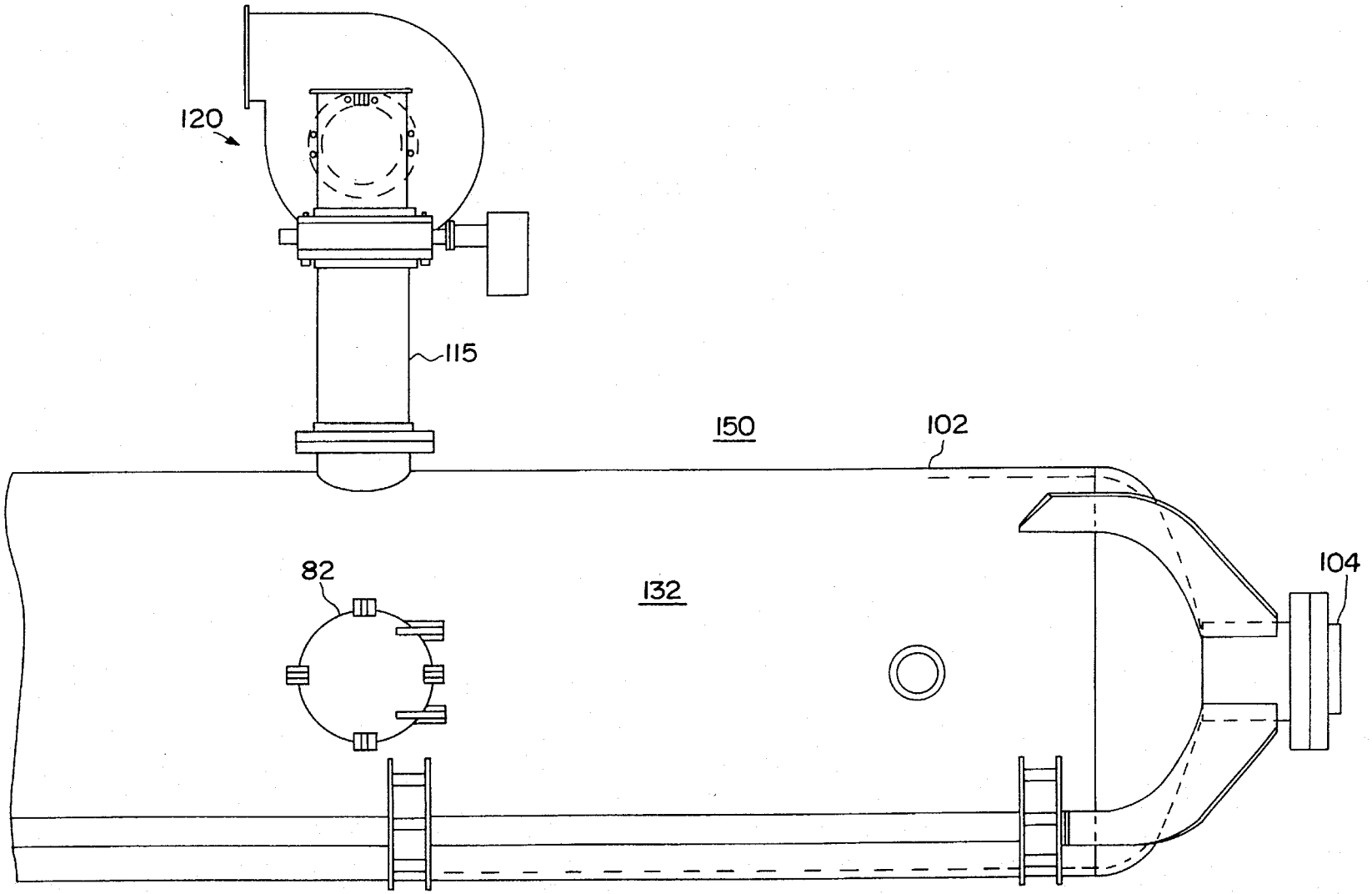
FIG. 10 is a fragmentary longitudinal side elevational view of the right portion of a second embodiment of a gun muffler of the present invention.
Figure 10A:
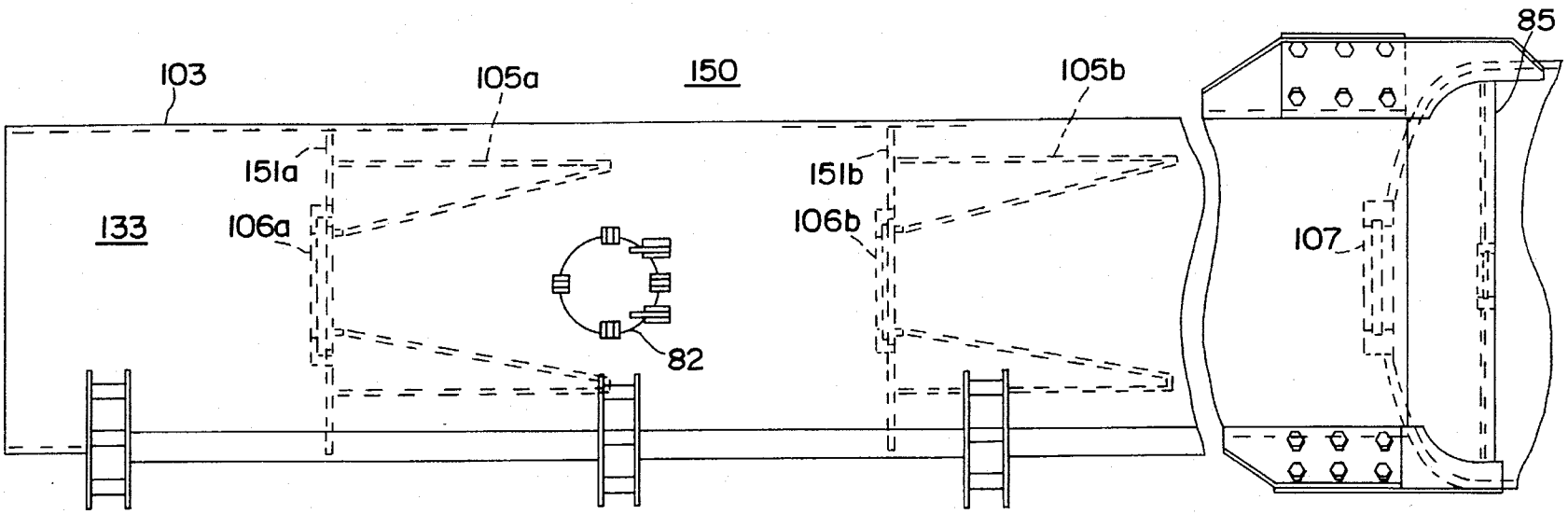
FIG. 10A is a fragmentary longitudinal side elevational view of the left portion of the gun muffler shown in FIG. 10.

A gun muffler 150 in accordance with a second embodiment of the present invention is shown in FIGS. 10 and 10A. In the same manner as the gun muffler of the first embodiment, gun muffler 150 includes a transition section 104 and at least one pressure vessel. Preferably, gun muffler 150 includes a main pressure vessel 102 defining a main pressure chamber 132 and an extension pressure vessel 103, disposed in series with and connected to main pressure vessel 102 and defining an extension pressure chamber 133. The volume and shape of the pressure vessels may be similar to the first embodiment. Also similar to the first embodiment, gun muffler 150 includes a vent stack 115 and an exhaust blower and valve assembly 120 connected to vent stack 115. As in the first embodiment, the valve of an exhaust blower and valve assembly 120, which preferably is a butterfly valve, closes during firings of the gun for preventing pressure waves caused by firing from escaping directly to the atmosphere during firing and opens between firings for permitting said exhaust blower to remove residual combustion gases from said pressure chamber.

Figure 9:
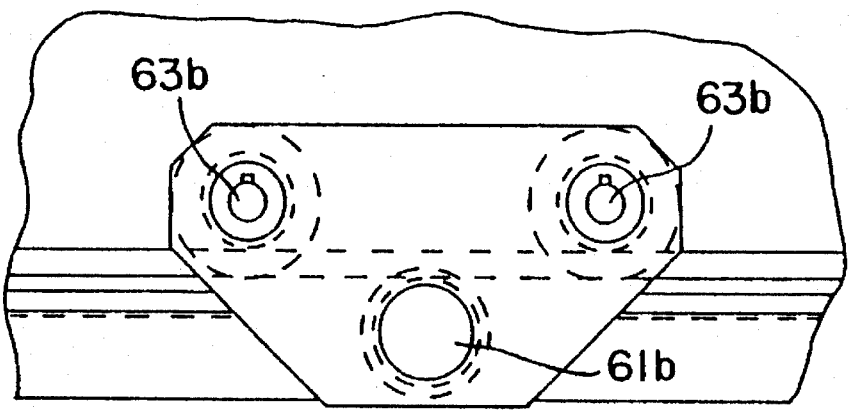
FIG. 9 is a fragmentary vertical sectional view of the tube transporter of FIG. 7, taken along the line 9—9 of FIG. 8.

The second embodiment of the invention may also incorporate some other features from the first embodiment. For example, the gun muffler of the second embodiment may include a tube transporter system shown in FIGS. 7–9.

Gun muffler 150 includes at least one orifice plate, which is adjustable relative to the pressure vessels and disposed in a pressure chamber, for attenuating pressure waves. More specifically, FIG. 10A shows three adjustable orifice plates. A first orifice plate 106*a* is disposed in extension chamber 133 and has a first orifice, through which the projectile passes and which is adjustable relative to the longitudinal axis of extension pressure vessel 103. A second orifice plate 106*b* is disposed in series with first orifice plate 106*a* in extension pressure chamber 133 and has a second orifice, through which the projectile passes and which is adjustable relative to the longitudinal axis of extension pressure vessel 103. First orifice plate 106*a* and second orifice plate 106*b* are identical. A third orifice plate 107 is disposed within extension pressure chamber 133 near the connection of main pressure vessel 102 to extension pressure vessel 103 and has a third orifice, through which the projectile passes and which is adjustable relative to the longitudinal axis of extension pressure vessel 103.

Figure 11:
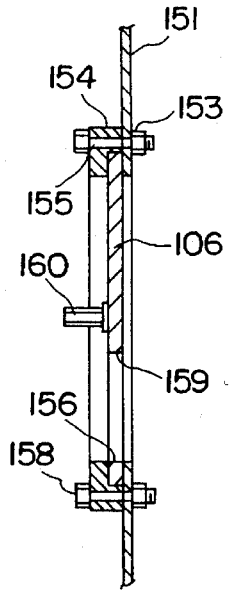
FIG. 11 is an enlarged fragmentary sectional view of the first and second orifice plates shown in FIG. 10A.

The orifice plates may be made adjustable in any known manner. FIG. 11 shows one way to make first and second orifice plates 106*a*, 106*b* adjustable. FIG. 11 shows either orifice plate and the surrounding elements and is discussed below with direct reference to first orifice plate 106*a* and parenthetical reference to second orifice plate 106*b*. A first (or second) mounting plate 151 is connected (i.e., welded or bolted) to extension pressure vessel 103 and has a first (or third) bolt hole 153. As shown in FIG. 10A, energy-absorbing baffles 105*a*, 105*b* may be respectively mounted to first and second mounting plates 151*a*, 151*b*. A first (or second) retaining ring 154 has a second (or fourth) bolt hole 155 aligned with first (or third) bolt hole 153 and has a first (or second) recess 156 confined by first (or second) mounting plate 151. First (or second) orifice plate 106 is secured to first (or second) mounting plate 151 and first (or second) retaining ring 154 at first (or second) recess 156.

A first (or second) bolt 158 extends through first bolt hole 153 and second bolt hole 155 (or through third and fourth bolt holes). By loosening first (or third) bolt 158, first (or second) orifice plate 106 may be adjusted to alter the location of first (or second) orifice 159 relative to the longitudinal axis of extension pressure vessel 103. For example, first (or second) orifice plate 106 may be rotated by rotating first (or second) handle 160, which is connected to first (or second) orifice plate 106. More than one handle may be used to rotate orifice plate 106 for ease of rotation. Upon reaching a desired position of first (or second) orifice, first (or third) bolt 158 is tightened to prevent further rotation of first (or second) orifice plate 106.

Figure 12:
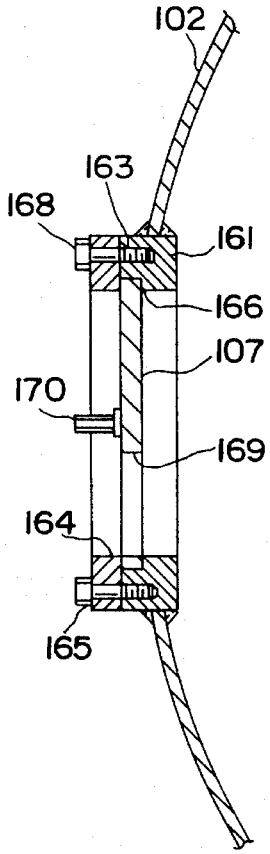
FIG. 12 is an enlarged fragmentary sectional view of the third orifice plate shown in FIG. 10A.

Similarly, as shown in FIG. 12, a third mounting plate 161 is connected (i.e., welded or bolted) to main pressure vessel 102 and has a third recess 166 and a fifth bolt hole 163. A third retaining ring 164 has a sixth bolt hole 165 aligned with fifth bolt hole 163 and confines third recess 166. Third orifice plate 107 is secured to third mounting plate 161 and third retaining ring 164 at third recess 166. A third bolt 168 extends through fifth bolt hole 163 and sixth bolt hole 165. By loosening third bolt 168, third orifice plate 102 may be adjusted to alter the location of third orifice 169 relative to the longitudinal axis of extension pressure vessel 103. For example, third orifice plate 107 may be rotated by rotating third handle 170, which is connected to third orifice plate 107. More than one handle may be used to rotate orifice plate 107 for ease of rotation. Upon reaching a desired position of third orifice, third bolt 168 is tightened to prevent further rotation of third orifice plate 107.

Figure 13:
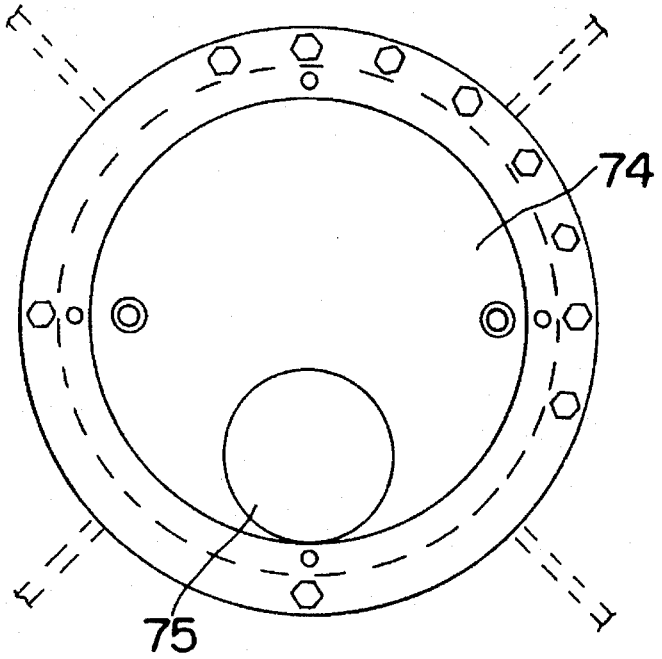
FIG. 13 is a plan view of an orifice plate having a circular, off-centered orifice.
Figure 14:
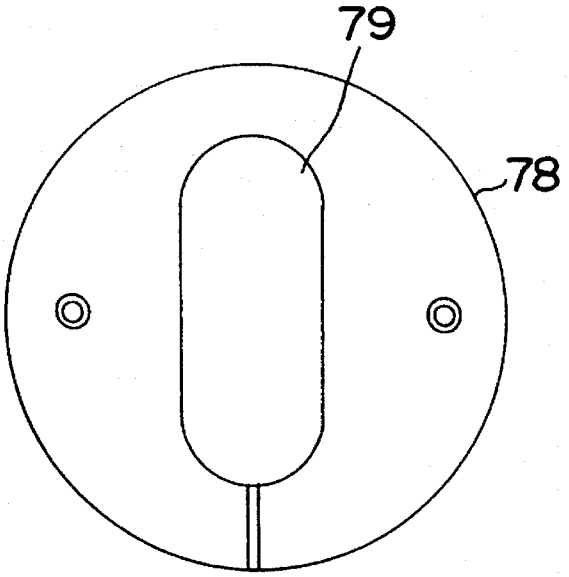
FIG. 14 is a plan view of an orifice plate having an elliptical orifice.

A first type of orifice plate is shown in FIG. 13. The orifice plate 174 as shown has an orifice 175 which is circular and disposed off-centered relative to the orifice plate. Also shown in FIG. 13 is a retainer ring. An alternative type of orifice plate is shown in FIG. 14. There, the orifice plate 178 as shown has an orifice 179 which is elliptical. The orifice plates are adjustable in order to accommodate varying trajectories. Also, orifice plate 178 having an elliptical orifice 179 is particularly useful if a projectile undergoes a drop in trajectory as it travels along the gun muffler.

As shown in FIG. 10A, a plurality of side ports 182 may be disposed along the sides of the pressure vessel. Side ports 182 may be used for a variety of purposes. For example, side ports 182 may be used for access, viewing, photography and radar. Side ports 182 may be made of a transparent material if used for viewing. According to this second embodiment of the invention, gun muffler 150 is not covered with sand in operation.

As shown in FIG. 10A, a sabot catcher 185 is disposed within one of the pressure vessels for entrapping particulates caused by the firing of a gun. Catcher 185 may be made of any suitable material for permitting gas to pass through but for preventing the passage of particulates. For example, it is known to use cables woven together as a sabot catcher. Catcher 185 is mounted to main pressure vessel 102, such as by being welded or bolted thereto. Catcher 185 is preferably disposed in main pressure chamber 132 near the connection of main pressure vessel 102 to extension pressure vessel 103.

Although illustrated and described herein with reference to certain specific embodiments, the claims of the present invention are nevertheless not intended to be limited to the details illustrated and described. Rather, the claims are meant to cover various common modifications without departing from the spirit of the invention.

What is claimed:

1. A muffler for a large caliber gun having a gun tube, said muffler comprising:

a transition section fitted around the gun tube and engaging the gun tube for preventing the escape of residual combustion gases caused by a firing of a projectile by the gun;

a generally cylindrical main pressure vessel, having a first end attached to said transition section, and defining a main pressure chamber of about 4,000 cubic feet for containing residual combustion gases and attenuating pressure waves;

a generally cylindrical extension pressure vessel, disposed in series with and connected to said main pressure vessel, and defining an extension pressure chamber of about 1,000 cubic feet for containing residual combustion gases and attenuating pressure waves; and at least one orifice plate, which is adjustable relative to said pressure vessel, disposed in at least one of said main pressure chamber and said extension pressure chamber for attenuating pressure waves.

2. A muffler according to claim 1 further comprising a plurality of side ports disposed along at least one of said main pressure vessel and said extension pressure vessel.

3. A muffler according to claim 1 further comprising a catcher disposed within at least one of said main pressure vessel and said extension pressure vessel for entrapping particulates.

4. A muffler according to claim 3, wherein said catcher is disposed in said main pressure chamber near the connection of said main pressure vessel to said extension pressure vessel.

5. A muffler for a large caliber gun having a gun tube, said muffler comprising:

a transition section fitted around the gun tube and engaging the gun tube for preventing the escape of residual combustion gases caused by a firing of a projectile by the gun;

at least one pressure vessel, having a port, a first end attached to said transition section, and defining a pressure chamber for containing residual combustion gases and attenuating pressure waves;

a vent stack coupled to said pressure vessel at said port;

an exhaust blower, disposed in said vent stack, for removing residual combustion gases from said pressure chamber between firings;

valve means, disposed in said vent stack between said pressure chamber and said exhaust blower, for:

(a) closing during firings of the gun for preventing pressure waves caused by firing from escaping directly to the atmosphere during firing, and (b) opening between firings for permitting said exhaust blower to remove residual combustion gases from said pressure chamber; and at least one orifice plate, which is adjustable relative to said pressure vessel, disposed in said pressure chamber for attenuating pressure waves.

6. A muffler for a large caliber gun having a gun tube, said muffler comprising:

a transition section fitted around the gun tube and engaging the gun tube for preventing the escape of residual combustion gases caused by a firing of a projectile by the gun;

a main pressure vessel, having a first end attached to said transition section, and defining a main pressure chamber for containing residual combustion gases and attenuating pressure waves;

an extension pressure vessel, disposed in series with and connected to said main pressure vessel, and defining an extension pressure chamber for containing residual combustion gases and attenuating pressure waves;

a first orifice plate, disposed in said extension chamber and having a first orifice through which the projectile passes, and which is adjustable relative to the longitudinal axis of said extension pressure vessel, for attenuating pressure waves;

a second orifice plate, disposed in series with said first orifice plate in said extension chamber and having a second orifice through which the projectile passes, and which is adjustable relative to the longitudinal axis of said extension pressure vessel, for attenuating pressure waves;

a third orifice plate, disposed within said extension pressure chamber near the connection of said main pressure vessel to said extension pressure vessel and having a third orifice through which the projectile passes, and which is adjustable relative to the longitudinal axis of said extension pressure vessel, for attenuating pressure waves;

a first mounting plate connected to said extension vessel;

a first retaining ring coupled to said first mounting plate and having a first recess confined by said first mounting plate, wherein said first orifice plate is adjustably coupled to said first mounting plate and said first retaining ring at said first recess;

a second mounting plate connected to said extension vessel;

a second retaining ring coupled to said second mounting plate and having a second recess confined by said second mounting plate, wherein said second orifice plate is adjustably coupled to said second mounting plate and said second retaining ring at said second recess;

a third mounting plate connected to said main pressure vessel and having a third recess; and a third retaining ring coupled to said third mounting plate and confining said third recess, wherein said third orifice plate is adjustably coupled to said third mounting plate and said third retaining ring at said third recess.

7. A muffler according to claim 6, wherein said first orifice, said second orifice, and said third orifice are circular and are disposed off-centered relative to said first orifice plate, said second orifice plate, and said third orifice plate, respectively.

8. A muffler according to claim 6, wherein said first orifice, said second orifice, and said third orifice are elliptical.

9. A muffler for a large caliber gun having a gun tube, said muffler comprising:

a transition section fitted around the gun tube and engaging the gun tube for preventing the escape of residual combustion gases caused by a firing of a projectile by the gun;

at least one pressure vessel, having a first end attached to said transition section, and defining a pressure chamber for containing residual combustion gases and attenuating pressure waves;

at least one orifice plate, which is adjustable relative to said at least one pressure vessel, disposed in said pressure chamber for attenuating pressure waves;

a first and a second track extending parallel to one another and longitudinally along the inner surface of said at least one pressure vessel;

a supplemental tube extending longitudinally along the center axis of said at least one pressure vessel for engaging said gun tube during firing of the gun; and a supplemental tube transporter assembly, for transporting said a supplemental tube longitudinally along said at least one pressure vessel, comprising:

(a) a first pair of wheels for engaging and moving along said first track, (b) a second pair of wheels for engaging and moving along said second track, (c) a first extendable arm, coupled to said first pair of wheels, for selectively attaching to said supplemental tube, and (d) a second extendable arm, coupled to said second pair of wheels, for selectively attaching to said supplemental tube.

* * * * *